US006035534A

United States Patent [19]

Abbott

[11] Patent Number: 6,035,534

[45] Date of Patent: Mar. 14, 2000

[54] CARTON KNIFE

[75] Inventor: John P. Abbott, South Gardner, Me.

[73] Assignee: Progressive Distributors, Inc., Winthrop, Me.

[21] Appl. No.: 08/969,294

[22] Filed: Nov. 13, 1997

[51] Int. Cl.[7] ..... B26B 3/00

[52] U.S. Cl. ..... 30/2; 30/294

[58] Field of Search ..... 30/2, 293, 294, 30/DIG. 3

[56] References Cited

U.S. PATENT DOCUMENTS

| | | | |
|---|---|---|---|
| 1,254,208 | 1/1918 | Cunningham | 30/DIG. 3 |
| 2,095,164 | 10/1937 | Babb . | |
| 2,120,960 | 6/1938 | Arthur . | |
| 2,464,408 | 3/1949 | Lightburn . | |
| 2,601,724 | 7/1952 | Jones . | |
| 3,178,812 | 4/1965 | Lurie . | |
| 3,406,447 | 10/1968 | Travlos . | |
| 4,031,616 | 6/1977 | Hines et al. . | |
| 4,041,605 | 8/1977 | Selfridge . | |
| 4,744,146 | 5/1988 | Schmidt . | |
| 5,054,198 | 10/1991 | Gmoch . | |
| 5,285,574 | 2/1994 | Feltner . | |

*Primary Examiner*—Douglas D. Watts
*Attorney, Agent, or Firm*—Kevin M. Farrell

[57] ABSTRACT

A carton knife for opening a carton includes a body member and a blade supported by the body member. The blade has a cutting surface and a cutting edge disposed thereon, the cutting surface and the cutting edge being adapted for cutting movement through the carton during operative engagement of the knife with the carton. A guide is disposed on the body member and is adapted to engage and slide along an edge of the carton to maintain the knife at a predetermined orientation relative the carton during the operative engagement, in which the cutting surface is disposed at an oblique angle relative the edge of the carton. The oblique angle serves to maintain a leading portion of the cutting edge closer than a trailing portion to the edge of the carton. Advantageously, during cutting, the blade is biased towards the edge of the carton and thus away from product inside the carton. Moreover, the orientation of the blade generates a force vector towards the edge during cutting for improved tactile sensitivity.

6 Claims, 2 Drawing Sheets

CARTON KNIFE

BACKGROUND OF THE INVENTION

1. Field of the Invention

This invention relates to a utility knife, and more particularly to a knife having a guide adapted to facilitate opening of packages and cartons.

2. Background Information

It is common practice in various industries for workers to utilize utility knives to cut the top, or end panel, off of a corrugated cardboard package to provide efficient access to product inside. This is typically accomplished by by cutting about the perimeter or edge of the panel and then removing the panel. This activity is common in various industries, such as grocery, restaurant and others in which a relatively large volume of packages are received on a routine basis, which must then be unpacked prior to sale. For example, grocery store stock persons typically use a knife to remove the tops from cardboard boxes to provide quick access to the contents for stocking shelves. Conventional utility knives, however, when used for this purpose tend to be difficult to manipulate accurately and consistently. The knives may slip off the edge of the carton during cutting, creating a potentially dangerous situation. Moreover, the depth of cut is difficult to control, often leading to cuts that are either not deep enough to completely sever the panel, or are so deep as to damage the product inside, resulting in losses.

Attempts to overcome this difficulty have included provision of knifes equipped with various types of blade guides intended to maintain the cutting blade on a preferred trajectory along the edge of the carton. Examples of knives of this type are disclosed in U.S. Pat. Nos. 5,054,198 and 5,285,574. These knives include guides intended to maintain the cutting blades near the edges of the carton blades ostensibly to help prevent them from slipping off the edge during cutting. While these guides may represent an improvement relative to unguided knives, they are not without drawbacks. In particular, while the guides may help prevent the knife from inadvertently slipping off the carton, the depth of cut tends to be difficult to control. Even with such guided knives, a certain degree of skill on the part of a user is generally required to prevent the blade from cutting too deeply and damaging product inside the carton.

Thus, a need exists for a carton knife that is relatively easy to control for improved safety and reduced product damage.

SUMMARY OF THE INVENTION

According to an embodiment of this invention, a knife provided for cutting open a carton comprises:

a) a body member;

b) a blade supported by the body member, the blade having a cutting surface and a cutting edge disposed on a side of the cutting surface, the cutting surface and the cutting edge being adapted for cutting movement through the carton during operative engagement of the knife with the carton; and c) a guide disposed on the body member, the guide adapted to engage and slide along an edge of the carton to maintain the knife at a predetermined orientation relative the carton during the operative engagement, wherein during the operative engagement, the cutting surface is disposed at an oblique angle relative the edge of the carton.

In another aspect of the subject invention, a knife for cutting open a carton comprises:

a) a body member;

b) a blade supported by the body member, the blade adapted for cutting movement through the carton during operative engagement of the knife with the carton; the blade having a cutting edge disposed thereon, the cutting edge having a leading portion and a trailing portion, the leading portion being adapted to pass through the carton ahead of the trailing portion during the operative engagement; and c) a guide disposed on the body member, the guide adapted to engage and slide along an edge of the carton to maintain the knife at a predetermined orientation relative to the carton during the operative engagement, the leading portion being disposed a distance from the edge of the carton distinct from that of the trailing portion during operative engagement.

Moreover, in a specific embodiment of this aspect, the leading portion is disposed closer to the edge of the carton than is the trailing portion.

Advantageously, during cutting, the blade of the subject invention tends to track towards the edge of the carton and thus away from product placed inside the carton. Moreover, this orientation of the blade generates a relatively uniform force vector tending to lift the guide away from the carton during cutting. This force vector must be overcome by the user during cutting by application of an opposing force. The force vector thus tends to increase the user's tactile sensitivity during cutting to help prevent application of excessive force and product damage associated therewith.

The above and other features and advantages of this invention will be more readily apparent from a reading of the following detailed description of various aspects of the invention taken in conjunction with the accompanying drawings.

DETAILED DESCRIPTION OF THE PREFERRED EMBODIMENTS

Figure 3:
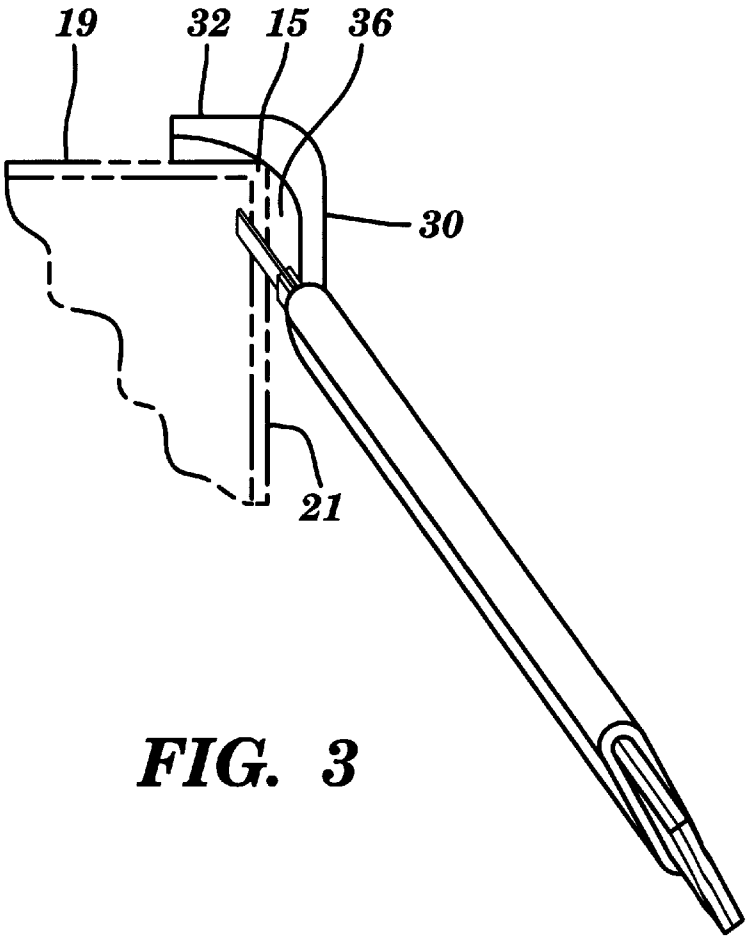
FIG. 3 is a perspective view of the carton knife of FIG. 2, during cutting engagement with a carton shown in phantom.

Referring to the figures set forth in the accompanying Drawings, the illustrative embodiments of the present invention will be described in detail hereinbelow. For clarity of exposition, like features shown in the accompanying Drawings shall be indicated with like reference numerals and similar features shall be indicated with similar reference numerals.

Figure 5:
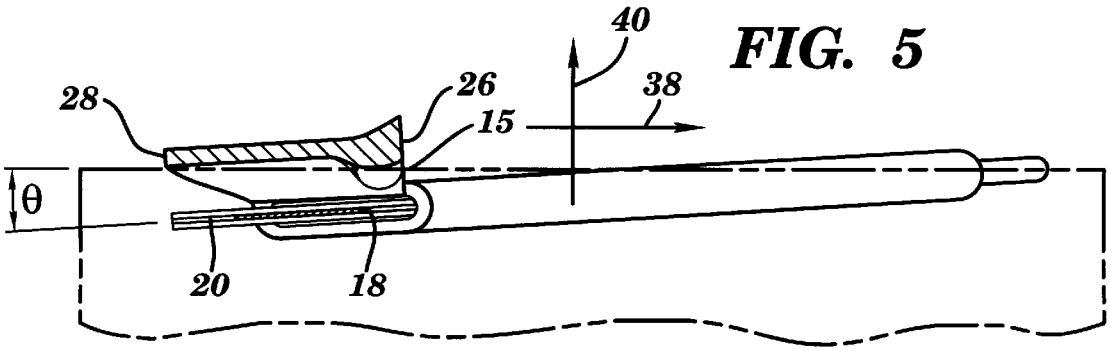
FIG. 5 is a cross-sectional view, with portions broken away, taken along 5—5 of FIG. 3.

Briefly described, the subject invention comprises a carton knife 110 (FIG. 2) that includes a blade 14 having a cutting edge 16 with a leading portion 18 and a trailing portion 20. The knife includes a guide 122 (FIG. 3) which, as best shown in FIG. 5, serves to engage and slide along a corner edge 15 of the carton during cutting movement. The guide serves to maintain blade 14 at an oblique angle θ relative to corner edge 15 during the cutting movement to maintain leading portion 18 closer than trailing portion 20 to the corner edge of the carton.

Figure 1:
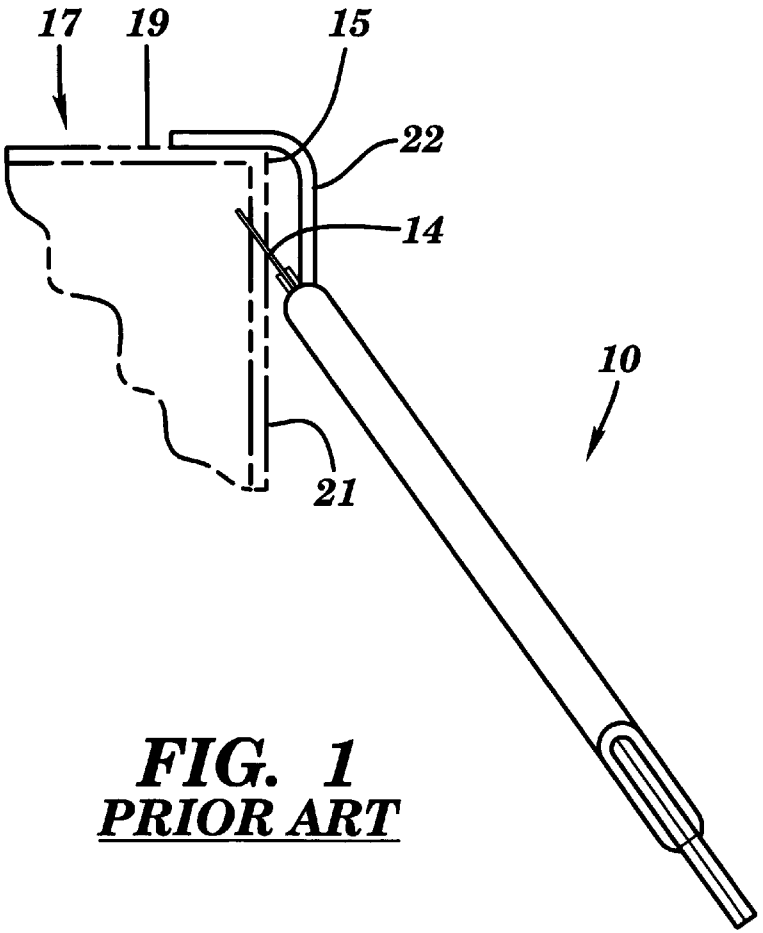
FIG. 1 PRIOR ART
FIG. 1 is a front elevational view of a carton opener of the prior art during cutting engagement with a carton shown in phantom.

Referring now to the drawings in detail, as shown in FIG. 1, a prior art utility knife 10 includes a guide 22 that ostensibly serves to maintain a blade 14 parallel to an edge 15 of a carton 17 during cutting movement. As shown, guide 22 is adapted to engage carton 17 on one side 19 of corner edge 15, without engaging the carton on the other, orthogonal side 21 thereof.

Figure 2:
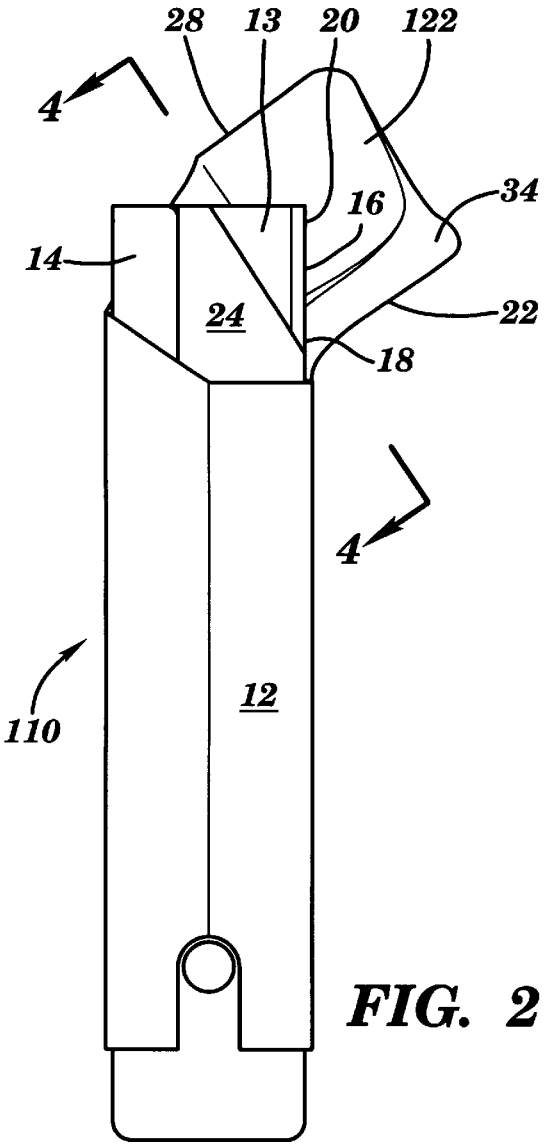
FIG. 2 is a plan view of a carton knife of the subject invention.

Turning now to FIG. 2, knife 110 of the present invention includes a body member 12 that serves to support blade 14 disposed at an end thereof. As shown, blade 14 is preferably supported within a slide member 24 slidably disposed within body member 12 to enable blade 14 to be retracted into body member 12 in a conventional manner when not in use. Blade 14 includes a cutting surface 13 having cutting edge 16 disposed thereon. Although cutting surface 13 is preferably planar, as shown, the cutting surface may be curved or concavo-convex, such as to emulate the cutting surface of a plow, as will be discussed in greater detail hereinafter.

Leading portion 18 of the cutting edge is disposed at a proximal end, and trailing portion 20 at a distal end, of edge 16. As shown, guide 122 is preferably disposed at the same end of body member 12 as blade 14. Guide 122 includes a leading edge 26 and trailing edge 28. In a preferred embodiment, as shown, a radiused lip member 34 is disposed along leading edge 26 to provide blade 14 with the oblique orientation relative to edge 15 as will be discussed in greater detail hereinafter. This oblique orientation, however, may be provided by any suitable means, such as by providing guide 122 with a predetermined twist or bend, or by fastening guide 122 at a predetermined angle relative to body member 12 in a manner that, in light of this specification, would be familiar to those skilled in the art.

Figure 4:
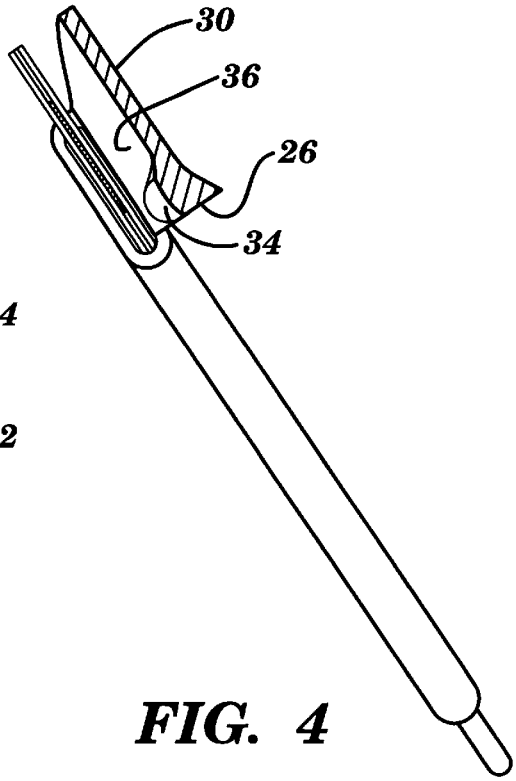
FIG. 4 is a cross-sectional view of the carton knife taken along 4—4 of FIG. 2.

Turning now to FIGS. 3 and 4, guide 122 comprises a pair of nominally planar portions 30 and 32 disposed generally orthogonally to one another to form a substantially concave or recessed side 36. As best shown in FIG. 4, in a preferred embodiment recessed side 36 includes lip 34 disposed along leading edge 26 as discussed hereinabove. Thus, as shown in FIG. 3, side 36 of guide 122 is adapted for operative engagement with corner edge 15 of the carton, including being engaged with the two orthogonally oriented sides 19 and 21 which define corner edge 15. During this engagement, cutting surface 13 of blade 14 is maintained at an oblique angle θ (FIG. 5) relative to corner edge 15.

Turning now to FIG. 5, during operation, a user engages guide 122 with carton 17 and slides carton knife 110 along corner edge 15 in direction 38 parallel thereto. During this engagement, both leading and trailing edges 26 and 28, respectively, are adapted for being superimposed with corner edge 15 as shown. Moreover, during this operation, trailing edge 28 is engaged with both sides 19 and 21 as shown and discussed hereinabove with respect to FIG. 3. Thus, throughout the cutting movement of the knife, guide 122 serves to maintain cutting surface 13 at the oblique angle θ, wherein leading portion 18 is located closer than trailing portion 20 to corner edge 15. The blade thus serves to cut the carton obliquely, or along a bias relative to corner edge 15 in a manner analogous to the action of a plow. Maintenance of this orientation during cutting tends to push blade 14 laterally towards the corner edge in the direction indicated by force vector 40. This aspect provides carton knife 110 with several advantages.

One advantage of biasing the blade in this manner is that in the event cutting edge 16 is extended too far into the carton, it will tend to pass harmlessly over the product, rather than into it.

Another advantage of this force vector 40 is improved tactile response of the knife during use. Force vector 40 must be resisted by the user during cutting. If the user applies an insufficient force, the knife will tend to ride up harmlessly towards edge 15. This effectively signals the user to increase pressure until contact is maintained between lip 34 and the edge. The user is thus provided with feedback as to the appropriate level of force needed to properly cut the carton. This feedback effectively enables a user to avoid applying excessive force to avoid the problem of deforming the carton, cutting too deeply and damaging product.

The present invention has been shown to be particularly effective with new or novice users who have not had extensive prior experience opening cartons using knives. Tests involving new grocery store employees have shown approximately 25–50% fewer damaged products using the knife of the present invention relative to prior art guided knives that orient the blade parallel to the carton edge. It is believed that this benefit may be due in large part to the improved tactile response of the present invention.

Another advantage of the present invention is provided by engagement of guide 122 with carton 17 on two orthogonal sides thereof. This two-sided engagement helps maintain blade 14 at its preferred orientation and prevent overcutting or gouging the carton.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described the invention, what is claimed is:

1. A knife for cutting open a carton, said knife comprising:

a) a body member;

b) a blade supported by said body member, said blade having a substantially planar cutting surface defining a cutting plane and a cutting edge disposed on a side of said cutting surface, said cutting surface and said cutting edge being adapted for cutting movement through the carton during operative engagement of the knife with the carton; and c) a guide disposed on said body member, said guide adapted to engage and slide along an edge of the carton to maintain said knife at a predetermined orientation relative the carton during said operative engagement, wherein during said operative engagement, the orientation of the cutting plane of said cutting surface being biased relative the edge of the carton.

2. The knife as set forth in claim 1, wherein said cutting edge has a leading portion and a trailing portion, said leading portion being adapted to pass through the carton ahead of said trailing portion during said operative engagement, said leading portion being disposed closer to the edge of the carton than said trailing portion during operative engagement.

3. The knife as set forth in claim 1, wherein said guide is adapted to simultaneously engage and slide along a plurality of orthogonal surfaces of the carton during said operative engagement.

4. The knife as set forth in claim 1, wherein said guide is substantially concavo-convex.

5. The knife as set forth in claim 4, wherein said guide comprises a pair of substantially planar members disposed substantially orthogonally to one another.

6. The knife as set forth in claim 5, wherein said guide further comprises a leading edge, a trailing edge and a radiused lip member disposed on said leading edge.

* * * * *